US010699861B2

(12) United States Patent
I

(10) Patent No.: US 10,699,861 B2
(45) **Date of Patent: *Jun. 30, 2020**

(54) ROCKER SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

This patent is subject to a terminal disclaimer.

(21) Appl. No.: 16/201,992

(22) Filed: Nov. 27, 2018

(65) Prior Publication Data

US 2020/0013569 A1 Jan. 9, 2020

(30) Foreign Application Priority Data

Jul. 3, 2018 (TW) ..... 107123017 A

(51) Int. Cl.

| | |
|---|---|
| ***H01H 23/14*** | (2006.01) |
| ***H01H 23/16*** | (2006.01) |
| ***H01H 37/20*** | (2006.01) |
| ***H01H 73/02*** | (2006.01) |

(52) U.S. Cl.

CPC ..... *H01H 23/14* (2013.01); *H01H 23/16* (2013.01); *H01H 37/20* (2013.01); *H01H 73/02* (2013.01)

(58) Field of Classification Search

CPC ..... H01H 23/14; H01H 23/16; H01H 37/20; H01H 37/32; H01H 37/76; H01H 73/02; H01H 85/08; C22C 12/00

USPC ..... 200/339, 5 A, 315, 553, 559, 43.16

See application file for complete search history.

(56) References Cited

U.S. PATENT DOCUMENTS 3,678,229 A * 7/1972 Osika ..... H01H 3/20 200/43.01
4,127,754 A * 11/1978 Josemans ..... H01H 23/28 200/275
5,095,181 A * 3/1992 Osika ..... H01H 3/20 200/339

(Continued)

FOREIGN PATENT DOCUMENTS

TW 321352 11/1997
TW 560690 11/2003

*Primary Examiner* — William A Bolton

(74) *Attorney, Agent, or Firm* — Michael D. Eisenberg

(57) ABSTRACT

A rocker switch having a sliding and pressing element, comprising a thermal conductive shell and an overheating destructive element. The sliding and pressing element is applied to the rocker switch. The overheating destructive element can be destroyed at a destructive temperature, and the destructive temperature is between 100° C. to 250° C. The thermal conductive shell is pressed against a rocker conductive element of the rocker switch so as to control the rocker conductive element to be electrically connected or electrically disconnected. When the rocker conductive element is electrically connected, and if the overheating destructive element is overheated and destroyed, the rocker conductive element would be electrically disconnected, thereby realizing protection from overheating. The overheating destructive element is tightly adhered to the thermal conductive shell and is capable of completely absorbing a heat energy generated by a circuit, thus giving the element the advantage of high sensitivity.

10 Claims, 4 Drawing Sheets

(56) References Cited

U.S. PATENT DOCUMENTS

| | | | | |
|---|---|---|---|---|
| 6,876,290 | B2 * | 4/2005 | Yu | H01H 73/26 337/56 |
| 6,897,392 | B2 * | 5/2005 | Huang | H01H 23/205 200/315 |
| 10,403,459 | B1 * | 9/2019 | I | H01H 37/32 |
| 2012/0118717 | A1 * | 5/2012 | Hanson | H01H 23/143 200/5 A |

* cited by examiner

ROCKER SWITCH

CROSS REFERENCES TO RELATED APPLICATIONS

The present claims priority from Taiwanese Patent Application Serial Number 107123017, filed Jul. 3, 2018, the disclosure of which is hereby incorporated by reference herein in its entirety.

BACKGROUND OF THE INVENTION

(a) Field of the Invention

The present invention relates to a rocker switch and, more particularly, a switch having a sliding and pressing element combined with an overheating destructive element with the sliding and pressing element applied thereto, the sliding and pressing element is used to drive the rocker switch to be electrically connected, and to drive the rocker switch to be electrically disconnected when the overheating destructive element is overheated and destroyed.

(b) Description of the Prior Art

A rocker switch of the prior art controls a switch to make reciprocated pivotal movements within a certain angular range so as to control the switch to be connected and disconnected; for instance, in R.O.C. Patent No. 560690 which is entitled "Spark Shielding Structure of Diverter Switch", when the switch makes a pivotal movement, a position-fixing feature is used to fix the switch in a first position or a second position so as to make the switch connected or disconnected.

In R.O.C Patent No. 321352 which is entitled "Structure of the On-wire Switch", a switch structure having a fuse is disclosed, and yet the fuse is located in a path of a live wire of a power source, which means a current is required to flow through for protection to be available; given that only an overloaded current is more likely to cut-out the fuse, and since a fuse is required to allow currents to flow through during operation but also must be capable of being cut-out when there are excessive currents, a lead-tin alloy or zinc having low melting points are often used as fuses, whereby the conductive performances are much poorer than that of copper. Using an extension cord as an example, in which copper is mainly used as a conducting body, if the extension cord has combined therein the switch of the R.O.C. Patent No. 321352 for controlling a power source, the conductivity of the fuse would be poor, which leads to the issue of excessive energy consumption.

SUMMARY OF THE INVENTION

The present invention provides a protective switch which does not require a current to flow through to operate; the sensitivity thereof is increased as much as possible to achieve an excellent circuit protecting effect. On the basis of the above-mentioned reason, the present invention discloses a sliding and pressing element applicable to a rocker switch and used to control the rocker switch to be electrically connected or electrically disconnected; in the state of being electrically connected, the rocker switch can be overheated and destroyed to form an electrically disconnected state if a circuit is overheated, the sliding and pressing element comprises:

a thermal conductive shell having an inwardly concaved chamber; an overheating destructive element placed into the chamber and combined with the thermal conductive shell, wherein the overheating destructive element can be destroyed at a destructive temperature, whereby the destructive temperature is between 100° C. to 250° C.

In addition, the thermal conductive shell has an internal surface enclosed around the chamber, and the overheating destructive element is tightly adhered to the internal surface.

In addition, the thermal conductive shell comprises an opening end and an arc-shaped contact end opposite to the opening end, and the opening end is coupling the chamber. When the overheating destructive element is placed into the chamber, there is a difference in height between the overheating destructive element and the opening end.

In addition, the overheating destructive element is made of a material from one of the following: a plastic, a metal having a low melting point, and an alloy having a low melting point, wherein the alloy having a low melting point is an alloy consisted of bismuth and any one or more of cadmium, indium, silver, tin, lead, antimony and copper.

The present invention also discloses a rocker switch, comprising:

a base having a receiving space; a first conductive element penetrated into and provided in the base; a second conductive element penetrated into and provided in the base; a rocker conductive element configured in the receiving space, wherein the rocker conductive element is provided above the first conductive element and selectively connected to the second conductive element in the form of a rocker; an operating component assembled on the base, wherein the operating component comprises an operating element and a first elastic element, the operating element comprises a sliding and pressing element and a limiting element, the sliding and pressing element slidably moves on the rocker conductive element so as to enable the rocker conductive element to be contacted with or separated from the second conductive element in a manner of rocking motions, the sliding and pressing element comprises a thermal conductive shell and an overheating destructive element, in which the thermal conductive shell has an inwardly concaved chamber, and the overheating destructive element is placed into the chamber and combined with the thermal conductive shell, the overheating destructive element can be destroyed at a destructive temperature, whereby the destructive temperature is between 100° C. to 250° C., the first elastic element is compressively limited between the overheating destructive element and the limiting element and has a first elastic force; a second elastic element having a second elastic force, wherein the second elastic force acts on the operating element.

When the operating element is in a first position, the first elastic force forces the rocker conductive element to be contacted with the second conductive element so as to form an electrically connected state; in the electrically connected state, currents flow through the first conductive element, the rocker conductive element and the second conductive element to generate a heat energy, and the overheating destructive element absorbs the heat energy and be destroyed at the described destructive temperature, such that the first elastic force is reduced or lost, thus making the second elastic force to be greater than the first elastic force, and the second elastic force forces the operating element to move to a second position, such that the rocker conductive element becomes separated from the second conductive element to form an electrically disconnected state.

In addition, the thermal conductive shell comprises an opening end and an arc-shaped contact end opposite to the opening end, wherein the opening end is coupling the chamber, so as to enable the first elastic element to be extended into the chamber from the opening end and pressed against the overheating destructive element, and the contact end is pressed against the rocker conductive element.

In addition, a width of the first elastic element is substantially equivalent to a width of the opening end of the thermal conductive shell.

In addition, the limiting element has an inwardly concaved accommodating space provided therein, wherein the accommodating space has an opening and the first elastic element is placed into the accommodating space, the thermal conductive shell is extended into the accommodating space from the opening, but the contact end is enabled to be protrudingly extended from the opening.

The following effects can be achieved according to the aforesaid technical features:

1. The overheating destructive element is tightly adhered to the internal surface of the thermal conductive shell and is capable of completely absorbing a heat energy generated by a circuit, thus giving the element the advantage of high sensitivity.

2. The overheating destructive element is not located in a path of current transmission and is not responsible for transmitting currents; therefore, when the present invention is applied to an electrical appliance or an extension cord, the electricity consumption performance of the electrical appliance or the extension cord will not be directly affected even though the conductivity of the overheating destructive element is not as good as that of copper.

3. The present invention is structurally simple overall and easy to manufacture without increasing a size of the switch obviously, and the production cost is relatively lower and easy to be implemented in known rocker switches.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

In summary of the above-described technical features, the primary effects of the rocker switch of the present invention and the sliding and pressing element thereof can be clearly illustrated in the following embodiments, wherein the sliding and pressing element is a part of the rocker switch and is used to control the rocker switch to be electrically connected or electrically disconnected.

Figure 1:
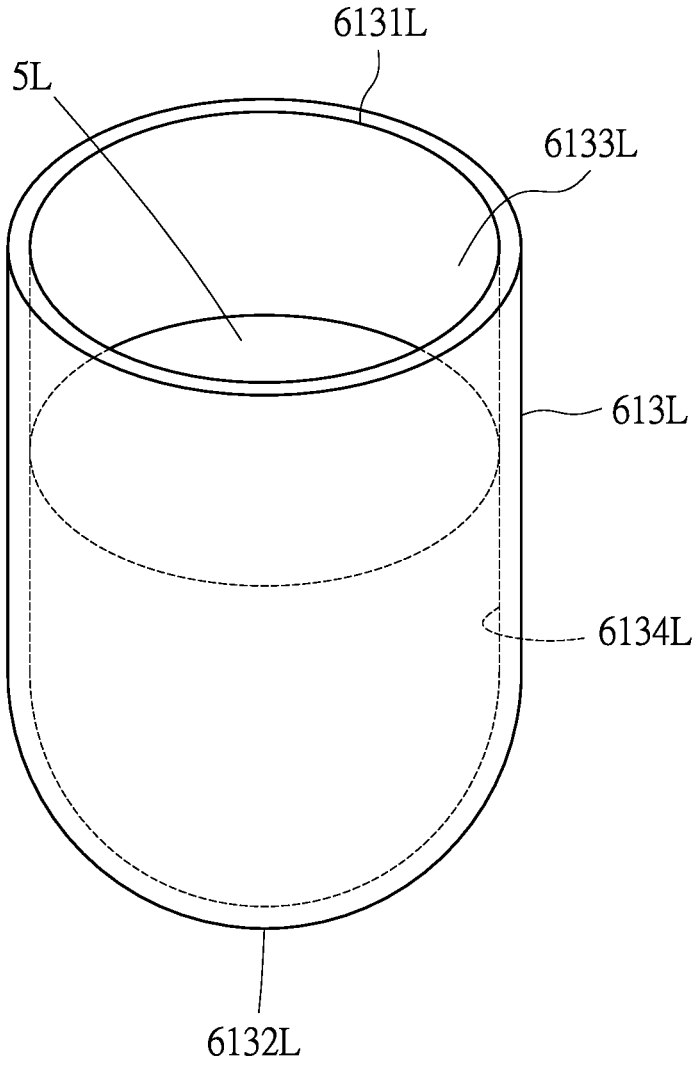
FIG. 1 illustrates a stereoscopic view of a sliding and pressing element in accordance with the present invention.
Figure 2:
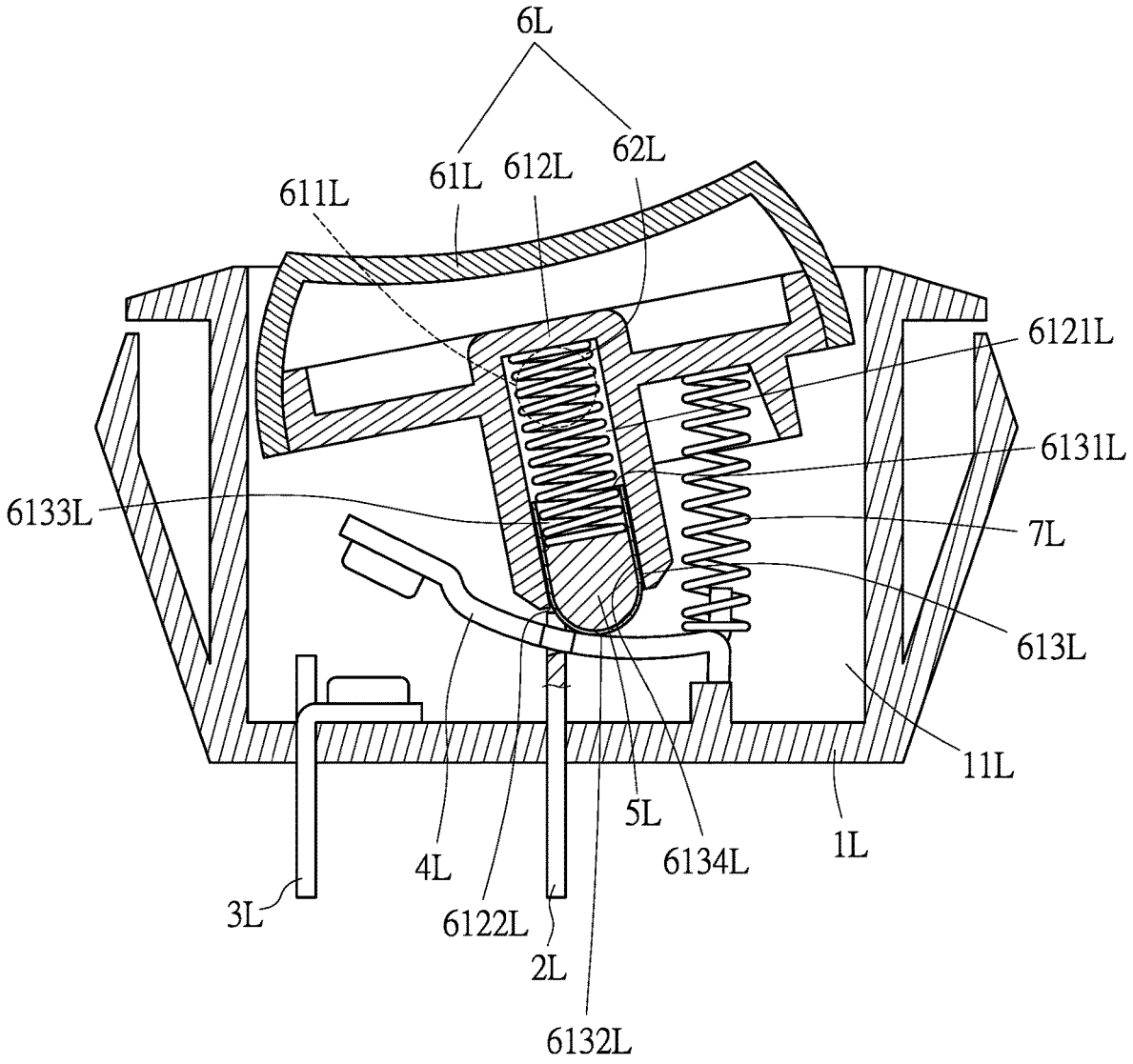
FIG. 2 is a schematic view showing a rocker switch in accordance with an embodiment of the present invention, in which structure of the rocker switch and a switch-off position of the rocker switch are shown.

Referring to FIGS. 1 and 2, the rocker switch of the embodiment comprises:

a base (1L) having a receiving space (11L); a first conductive element (2L) and a second conductive element (3L) both penetrated into and provided in the base (1L); a rocker conductive element (4L) provided in the receiving space (11L), wherein the rocker conductive element (4L) is provided above the first conductive element (2L) and electrically connected to the first conductive element (2L); an operating component (6L) used to operate the rocker conductive element (4L) to be connected to the first conductive element (2L) and the second conductive element (3L), or disconnected from the first conductive element (2L) and the second conductive element (3L); when an operating temperature rises to an abnormal temperature, a disconnection is preferably to be generated in the live wire; therefore, the first conductive element (2L) is used as a first end of the live wire, and the second conductive element (3L) is used as a second end of the live wire, such that when the rocker conductive element (4L) connects and enables the first conductive element (2L) and the second conductive element (3L) to be connected, a live wire is formed; when the rocker conductive element (4L) is disconnected and thus breaking the connection between the first conductive element (2L) and the second conductive element (3L), the live wire is disconnected.

The operating component (6L) is assembled on the base (1L) and comprises an operating element (61L) and a first elastic element (62L), wherein the operating element (61L) is provided with a pivotal point (611L) and the pivotal point (611L) is pivotally connected to the base (1L), such that the operating element (61L) can be rotated reciprocally in a limited manner by having the pivotal point (611L) as an axle center. The operating element (61L) further comprises a sliding and pressing element and a limiting element (612L), wherein the sliding and pressing element slidably moves on the rocker conductive element (4L), such that the rocker conductive element (4L) is enabled to be contacted with or separated from the second conductive element (3L) in a manner of rocking motions. The sliding and pressing element comprises a thermal conductive shell (613L) and an overheating destructive element (5L), wherein the thermal conductive shell (613L) has an inwardly concaved chamber (6133L) and an internal surface (6134L) enclosed around the chamber (6133L), whereby the overheating destructive element (5L) is placed into the chamber (6133L) and tightly adhered to the internal surface (6134L). The overheating destructive element (5L) can be destroyed at a destructive temperature, and the destructive temperature is between 100° C. and 250° C. The thermal conductive shell (613L) further comprises an opening end (6131L) and an arc-shaped contact end (6132L), and the contact end (6132L) is in contact with the rocker conductive element (4L). It should be noted that the overheating destructive element (5L) is not used to maintain a continuous supply of currents, and thus can be selectively made of an insulative material such as a plastic, or selected from a non-insulative material such as an alloy having a low melting point or other metals having a low melting point between 100° C. and 250° C., wherein the alloy having a low melting point can be, for instance, an alloy consisted of bismuth and any one or more of cadmium, indium, silver, tin, lead, antimony and copper, in which a tin-bismuth alloy has a melting point approximately between 138° C. and 148° C. according to different compositions and is a preferable material. The limiting element (612L) is provided with an inwardly concaved accommodating space (6121L), and the accommodating space (6121L) has an opening (6122L), the first elastic element (62L) is placed into the accommodating space (6121L) and the thermal conductive shell (613L) is coupling the limiting element (612L) to seal off the opening (6122L), such that the first elastic element (62L) is extended into the thermal conductive shell (613L) from the opening end (6131L) and pressed against the overheating destructive element (5L); the first elastic element (62L) is thus compressed and enabled to have a first elastic force, and a width of the first elastic element (62L) is substantially equivalent to a width of the opening end (6131L) of the thermal conductive shell (613L); the essential equivalence refers to that the width of the first elastic element (62L) is slightly less than the width of the opening end (6131L) of the thermal conductive shell (613L), such that the first elastic element (62L) is enabled to be moved along a set track.

The rocker switch of the embodiment further has a second elastic element (7L), and the second elastic element (7L) is a spring in this embodiment; the second elastic element (7L) has a second elastic force which is applied to the operating element (61L) and the rocker conductive element (4L).

Figure 3:
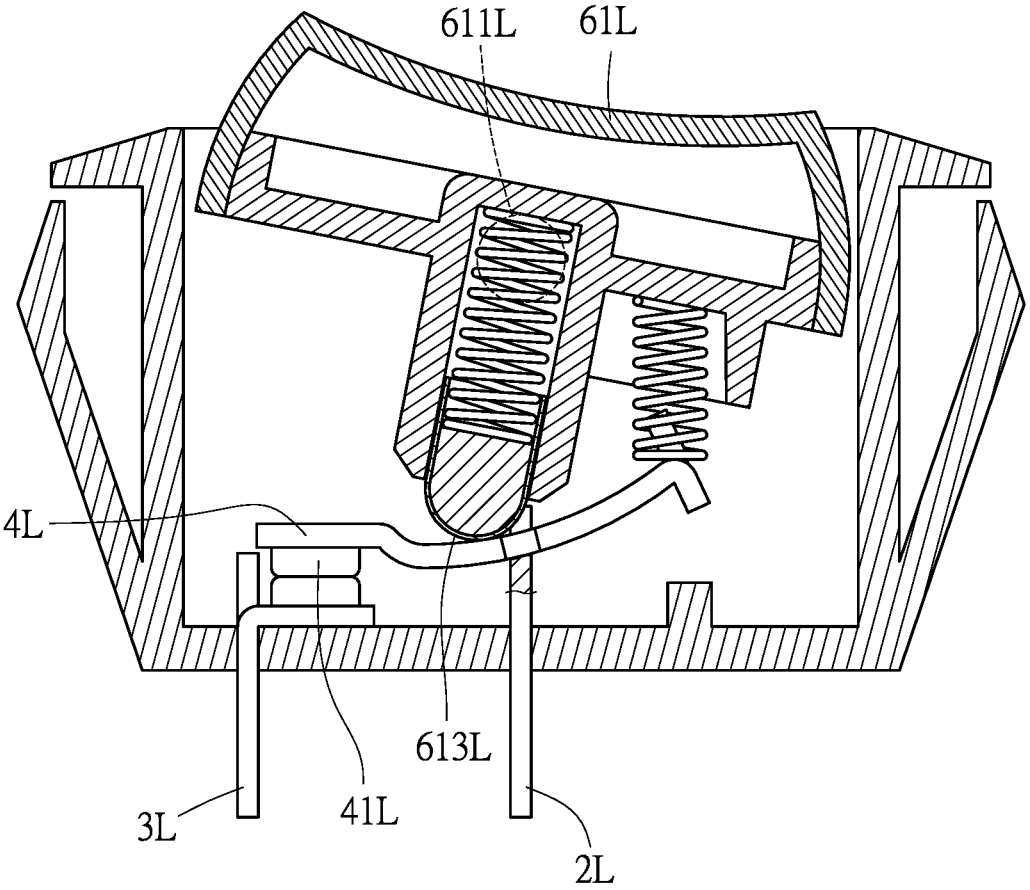
FIG. 3 is a schematic view showing the rocker switch in accordance with an embodiment of the present invention, whereby the rocker switch is in a switch-on position.

Referring to FIG. 3, a user enables the thermal conductive shell (613L) to slidably move on the rocker conductive element (4L) by operating the operating element (61L) to rotate around the pivotal point (611L), so as to drive the rocker conductive element (4L) to be selectively contacted with or separated from the second conductive element (3L) in a manner of rocking motions. When the thermal conductive shell (613L) slidably moves on the rocker conductive element (4L) towards a silver contact point (41L) on the rocker conductive element (4L), the moment of force applied by the first elastic force towards the rocker conductive element (4L) will become greater than the moment of force applied by the second elastic force towards the rocker conductive element (4L), thereby forcing the silver contact point (41L) to be contacted with the second conductive element (3L) and thus forming an electrically connected state.

Figure 4:
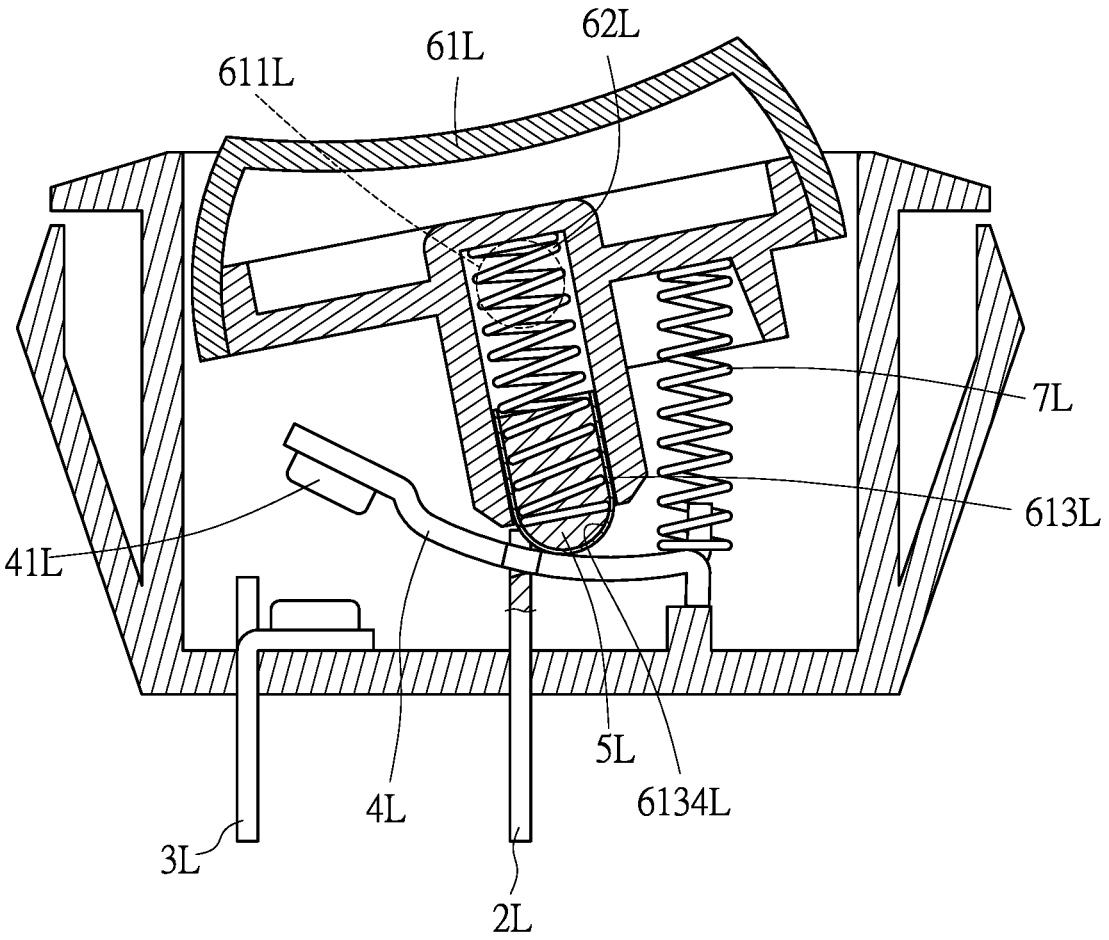
FIG. 4 is a schematic view showing the rocker switch in accordance with an embodiment of the present invention, whereby the rocker conductive element is separated from the second conductive element so as to enable the rocker switch to be returned to the switch-off position from the switch-on position when the overheating destructive element is overheated and destroyed, thereby achieving protection from overheating.

Referring to FIGS. 1 and 4, when an external conducting apparatus connected to the first conductive element (2L) or the second conductive element (3L) is in an abnormal state; for example, the external conducting apparatus may be a power socket, and when there are oxidizing substances, dusts, incomplete insertion of metal pins and deformations of metal pins present between the metal pins of a plug and the power socket, consequently resulting the generation of a greater heat energy in a conductive part of the power socket, the heat energy is transmitted to the rocker conductive element (4L) via the first conductive element (2L) or the second conductive element (3L), and then transmitted to the overheating destructive element (5L) via the thermal conductive shell (613L), the overheating destructive element (5L) absorbs the heat energy and gradually reaches a material melting point thereof, whereby the rigidity thereof is gradually lost; for instance, in case the overheating destructive element (5L) is made of a tin-bismuth alloy, although a melting point thereof is 148° C., the rigidity is reduced when a temperature thereof is close to the melting point; therefore, under the effect of the first elastic force, the overheating destructive element (5L) is pressed and deformed or even broken by the first elastic element (62L), such that the moment of force applied by the second elastic force towards the rocker conductive element (4L) will become greater than the moment of force applied by the first elastic force towards the rocker conductive element (4L), thereby enabling the silver contact point (41L) of the rocker conductive element (4L) to be separated from the second conductive element (3L). Referring to FIGS. 1 and 4, when the overheating destructive element (5L) is placed into the chamber (6133L), there is a difference in height between the overheating destructive element (5L) and the opening end (6131L), so as to prevent the overheating destructive element (5L) from overflowing out of the chamber (6133L) when the first elastic element (62L) is extended into an internal portion of the overheating destructive element (5L) due to the overheating destructive element (5L) being overheated and destroyed. It should be further noted that in this embodiment, an arrangement direction of the first elastic element (2L) and the second elastic element (3L) is defined as a transverse direction, and the operating element (61L) has a length in the transverse direction; the first elastic element (62L) is configured in a central position of the length, and a distance is present between a configured position of the second elastic element (7L) and the central position; therefore, when the second elastic force becomes greater than the first elastic force, the operating element (61L) is enabled to be rotated by having the pivotal point (611L) as an axle center due to the effect of moments, thereby driving the thermal conductive shell (613L) to slidably move on the rocker conductive element (4L) and forcing the operating element (61L) to move to a switch-off position, such that the silver contact point (41L) of the rocker conductive element (4L) is separated from the second conductive element (3L) and a state of electrical disconnection is formed, thus achieving protection from overheating. In addition, the overheating destructive element (5L) is pressed against the internal surface (6134L) of the thermal conductive shell (613L) and is capable of completely absorbing a heat energy generated by a circuit, thus giving the overheating destructive element (5L) the advantage of high sensitivity.

In summary of the description of the aforesaid embodiments, it is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A rocker switch, comprising:

a base having a receiving space;

a first conductive element penetrated into and provided in the base; a second conductive element penetrated into and provided in the base;

a rocker conductive element configured in the receiving space, wherein the rocker conductive element is provided above the first conductive element and selectively connected to the second conductive element in the form of a rocker;

an operating component assembled on the base, wherein the operating component comprises an operating element and a first elastic element, the operating element comprises a sliding and pressing element and a limiting element, and the sliding and pressing element comprises a thermal conductive shell and an overheating destructive element, the thermal conductive shell has an inwardly concaved chamber, in which the overheating destructive element is placed into the chamber and combined with the thermal conductive shell, the overheating destructive element can be destroyed at a destructive temperature, whereby the destructive temperature is between 100° C. and 250° C., the sliding and pressing element slidably moves on the rocker conductive element so as to enable the rocker conductive element to be contacted with or separated from the second conductive element in a manner of rocking motions, the first elastic element is compressively limited between the overheating destructive element and the limiting element and has a first elastic force;

a second elastic element having a second elastic force, wherein the second elastic force acts on the operating element and the first elastic force is greater than the second elastic force under a normal condition;

when the operating element is in a first position, the first elastic force forces the rocker conductive element to be contacted with the second conductive element to form an electrical connected state, under the electrical connected state, a current flows through the first conductive element, the rocker conductive element and the second conductive element and generates a heat energy, the overheating destructive element absorbs the heat energy and becomes destroyed at the destructive temperature, the first elastic force is therefore reduced or lost as a result, while the second elastic force is greater than the first elastic force, and the second elastic force forces the operating element to move to a second position, such that the rocker conductive element is separated from the second conductive element to form a state of electrical disconnection.

2. The rocker switch of claim 1, wherein the thermal conductive shell has an internal surface enclosed around the chamber, and the overheating destructive element is tightly adhered to the internal surface.

3. The rocker switch of claim 1, wherein the thermal conductive shell comprises an opening end and an arc-shaped contact end opposite to the opening end, and the opening end is coupling the chamber.

4. The rocker switch of claim 3, wherein when the overheating destructive element is placed into the chamber, there is a difference in height between the overheating destructive element and the opening end.

5. The rocker switch of claim 3, wherein a width of the first elastic element is substantially equivalent to a width of the opening end of the thermal conductive shell.

6. The rocker switch of claim 3, wherein the limiting element has an inwardly concaved accommodating space provided therein, the accommodating space has an opening and the first elastic element is placed into the accommodating space, the thermal conductive shell is extended into the accommodating space from the opening, but the contact end is enabled to be protrudingly extended from the opening.

7. The rocker switch of claim 1, wherein a material of the overheating destructive element is from one of the following: a plastic, a metal having a low melting point, and an alloy having a low melting point.

8. The rocker switch of claim 7, wherein the alloy having a low melting point is an alloy consisted of bismuth and any one or more of cadmium, indium, silver, tin, lead, antimony and copper.

9. The rocker switch of claim 7, wherein the alloy having a low melting point is a tin-bismuth alloy.

10. The rocker switch of claim 1, wherein the thermal conductive shell comprises an opening end and an arc-shaped contact end opposite to the opening end, the opening end is coupling the chamber so as to enable the first elastic element to be extended into the chamber from the opening end and pressed against the overheating destructive element, and the contact end is pressed against the rocker conductive element.

* * * * *